US009928814B2

(12) United States Patent
Cooper

(10) Patent No.: US 9,928,814 B2
(45) Date of Patent: Mar. 27, 2018

(54) METHOD FOR IMPROVING GRIP OF PERCUSSION MALLETS

(71) Applicant: Carlo Cooper, Oak Park, IL (US)

(72) Inventor: Carlo Cooper, Oak Park, IL (US)

( * ) Notice: Subject to any disclaimer, the term of this patent is extended or adjusted under 35 U.S.C. 154(b) by 0 days.

(21) Appl. No.: 15/384,569

(22) Filed: Dec. 20, 2016

(65) Prior Publication Data

US 2017/0330534 A1 Nov. 16, 2017

Related U.S. Application Data

(63) Continuation of application No. 29/564,830, filed on May 16, 2016, now Pat. No. Des. 802,652.

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
USPC ..... 84/422.4
See application file for complete search history.

(56) References Cited

U.S. PATENT DOCUMENTS

| | | | | | |
|---|---|---|---|---|---|
| 1,484,777 | A * | 2/1924 | Hassenpflug | G10D 13/003 | 84/422.4 |
| 4,488,470 | A * | 12/1984 | Larrain | G10D 13/003 | 84/422.4 |
| 5,520,090 | A * | 5/1996 | Eagle | G10D 13/029 | 84/411 P |
| D720,391 | S * | 12/2014 | Cacciolo, Jr. | D17/22 | |
| D720,392 | S * | 12/2014 | Cacciolo, Jr. | D17/22 | |
| D724,137 | S * | 3/2015 | Cacciolo, Jr. | D17/22 | |
| D724,651 | S * | 3/2015 | Cacciolo, Jr. | D17/22 | |
| 9,318,083 | B2 * | 4/2016 | Cacciolo, Jr. | G10D 13/003 | |
| 2002/0002895 | A1 * | 1/2002 | Zbrzezny | G10D 13/003 | 84/422.4 |
| 2004/0025666 | A1 * | 2/2004 | Mizuno | G10D 13/003 | 84/422.4 |
| 2008/0250911 | A1 * | 10/2008 | Heselton | G10D 13/003 | 84/422.4 |
| 2014/0123832 | A1 * | 5/2014 | Huber | G10D 13/003 | 84/422.4 |

OTHER PUBLICATIONS

CooperGroove.com "About Us," printed from Internet Jan. 23, 2017.*
Facebook posts, Oct. 22, 2015 and Sep. 27, 2016, Cool Stuff for Drummers group, printed from Internet Jan. 23, 2017.*

* cited by examiner

*Primary Examiner* — Jeffrey Donels
(74) *Attorney, Agent, or Firm* — Richards Patent Law P.C.

(57) ABSTRACT

A percussion mallet and method of producing percussion mallets featuring a plurality of grooves on the grip portion of the mallet which improve grip and prevent discomfort.

11 Claims, 3 Drawing Sheets

METHOD FOR IMPROVING GRIP OF PERCUSSION MALLETS

BACKGROUND OF THE INVENTION

The present subject matter relates generally to a method for improving grip of handheld implements. More specifically, the present invention relates to both methods and devices for improving the grip of percussion mallets and other handheld implements.

Percussion instruments are some of the oldest and most pervasive types of musical implements. Many historians believe rudimentary percussion instruments were the first instruments ever used by humans and are commonly referred to as "the backbone" or "the heartbeat" of musical performances even today. Most modern percussionist utilize drum sticks (technically a type of percussion mallet) during such performances and while the shape and style of drum sticks vary, most share some common attributes. The archetypical drum stick is turned from a single piece of wood—most commonly of hickory, maple, or oak. Drum sticks of this traditional form are also made from metal, carbon fiber and other modern materials.

Almost all drum sticks feature various parts with distinct functions including: the tip (or bead) which is the part most often used to strike instruments, the shoulder which tapers towards the tip and is normally slightly convex, the shaft or body which is typically cylindrical, and the butt located at the opposite end of the stick from the tip. While this generic description may vary from stick to stick, the overall design of most sticks is generally the same and, as mentioned above, ubiquitous in almost every form of music.

The drum stick, while readily identifiable by most, is not without flaws; one such issue being their smooth cylindrical shafts. This area is commonly where musicians grip the sticks and, being a smooth cylinder made of wood or other rigid material, can be difficult to grip. This difficulty increases greatly when a musician's hands become moist from perspiration, rain, stage effects, etc. Once a musician's grip is compromised, they risk losing hold of their sticks mid-performance or, as the stick moves only slightly in their grasp, developing painful blisters which can limit play time.

The smooth shaft of drumsticks also provides no tactile feedback to a percussionist about where they are gripping the stick in relation to the tip or butt of the stick. This can be important information for, as an example, Rock and Metal musicians who regularly play their drums with both ends of the stick. Additionally, high intensity drummers regularly lose their sticks while furiously playing, requiring them to blindly grab a replacement stick if available. When grabbing such a replacement stick, the drummer has no idea towards which end of the shaft they are holding and thus are required to examine the stick visually or by feel, potentially interrupting the aforementioned "heartbeat" or a performance.

Accordingly, there is a need for a percussion mallet which enables users to maintain a better grip, as described herein.

BRIEF SUMMARY OF THE INVENTION

To meet the needs described above and others, the present application describes a percussion mallet which enables users to achieve and maintain a better grip on the mallet and a method for improving the grip of such implements.

One preferred embodiment of the present invention features a drum stick with a series of grooves cut along the shaft of the stick closer to the butt end of the stick than to the tip.

The series of grooves is radially distributed along the outside of the stick shaft at equidistant intervals. The grooves are cut in rows at an angle that is skew of the axial length of the shaft. In this preferred embodiment, there are four rows of grooves in total cut into the stick. One set of two groove rows is offset relative to the other set of two groove rows with one set beginning closer to the tip end of the stick and one set beginning closer to the butt end. The length of the grooves extends around the circumference of the stick so that there is a slight overlap between the offset rows of grooves. The grooves are spaced equidistant in relation to the other grooves in their respective set (those grooves located directly above and below them on the stick, as applicable).

In the preferred embodiment, the shape of the grooves themselves may roughly translate to a prolate spheroid (a shape which is longer than it is around) which has been bisected along its length, with the groove's shape coming to a point at both ends. The depth to which the grooves are cut into the stick may vary and the orientation of the grooves relative to the stick may place the lengthwise axis of the grooves roughly 45 degrees off the lengthwise axis of the stick. It should be noted the series of grooves may be positioned along the shaft as preferred by users with the tip, shoulder, and butt of the drum stick resembling a standard drum stick. The drum sticks of the present invention may be composed of any material or material(s) suitable for use as a drum stick including wood, metal, or carbon fiber.

While the above describes only one type of specialized percussion mallet (a drum stick), the improved grip shaft disclosed in this application may be applied to any percussion mallet or similar musical implement including, but not limited to: marimba mallets, vibraphone mallets, xylophone mallets, keyboard mallets, bell mallets, timpani mallets, bass drum mallets, gong mallets, drum brushes, and drum broomsticks.

The grooves may also be applied to any other type of handheld implement including hand tools such as hammers, wrenches, and gardening/landscaping equipment. Sports equipment may also be improved by the current invention with the grooves being applied to the grip areas of baseball bats, golf clubs, hockey sticks, etc.

Application of the groves may be achieved by any number of functionally useful means. Such methods of groove application may include use of: Computer Numeric Control (CNC) machines, lasers, industrial sized lathes, smaller home tools, and even hand tools. Additionally, the grooves may be molded when forming the grip portion of a drumstick, etc. without the need to later cut the grooves into the stick material.

The current invention may also be described, in some embodiments, as a percussion mallet comprising: a cylindrical shaft defining a shaft axis along its length; a tip located at a first end of the shaft; a butt located at a second end of the shaft that is opposite the first end of the shaft; and, a plurality of grooves located along the shaft in between the butt and tip, each groove including a length, a width, and a depth, wherein the length is equal to greater than the width and the length defines a groove axis, wherein the groove axis of each of the plurality of grooves is at a skewed angle relative to the shaft axis.

The percussion mallet may be a drum stick and feature the plurality of groove axes skewed at an angle of 45 degrees relative to the shaft axis. The mallet may also feature a first groove and a second groove whose groove axes are oriented perpendicular to each other or include at least a first groove and a second groove whose groove axes are oriented perpendicular to each other with at least one inch of space between each groove in a row. Alternatively, the plurality of grooves may include at least a first groove and a second groove whose groove axes are oriented perpendicular to each other with a maximum of one inch of space between each groove in a row.

The plurality of grooves may be two or more rows, with these rows of grooves interleaving (or not). Each row may contain any number of grooves, including 5 or 10 grooves per row with the grooves potentially being prolate spheroid, circular, square, triangular, or rectangular in shape.

A goal of the present invention is to provide drummers and other musicians with a better grip on their drum sticks and other percussion mallets. As mentioned before, drum sticks can be difficult to grasp due to their smooth shafts. This difficulty can result in musical performances being interrupted and also limit the amount of time a musician can practice and perform. The present invention introduces a design change which maintains the look and feel of the common drum stick and also radically improves stick grip.

An advantage of the present invention is that the stick grooves reduce the impact that sweat and moisture on a musician's grip by preventing slippage and also allowing for better ventilation of a musician's hands while playing. Standard smooth drum stick shafts allow users to initially maintain a tight grasp on a stick against the smooth surface of the user's palm but, over extended periods, this tight grip creates perspiration which has no place to escape and eventually disrupts their grip. The grooves of the present invention provide a channel into which moisture can escape and air can flow, keeping the user's hands dry and grip tight.

The ability to maintain a continuous tight grip means decreased shock to the hands and reduced fatigue caused by drummers having to grip their sticks tighter when the aforementioned moisture builds up. The stick grooves also help ease hand and arm pain by stimulating pressure points on the hands to relax them and prevent cramps.

The improved grip provided by the present invention also eliminates the need for additional accessories some drummers opt to utilize to improve grip. These accessories include gloves which many musicians wear to prevent blisters and maintain a consistent grip on their drum sticks. The present invention removes the need for such protective gear, lowering both the physical and financial cost of playing percussion instruments for extended periods.

Another advantage of the present invention is that the grooves on a drum stick shaft provide tactile feedback based off the user's sense of touch. The grooves provide a physical indication of where the user is gripping the drum stick, allowing the user to know if they have proper grip on their sticks. As discussed previously, many drummers play with both the tip and butt of a drumstick and the present invention allows drummers to determine towards which end of the stick they are holding instantly and effortlessly.

The advantages discussed above may also be realized for other handheld implements to which the grooves are applied including hand tools and sports equipment.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
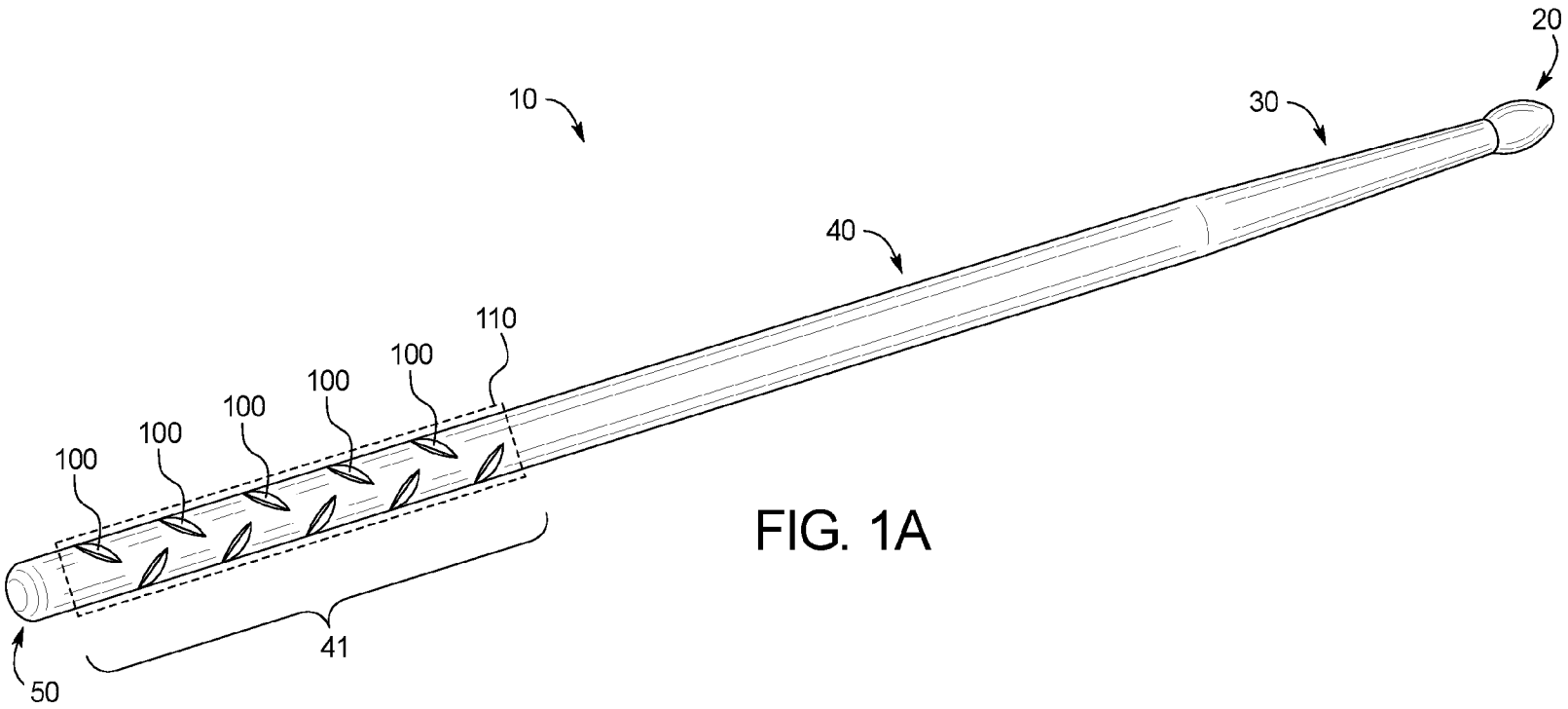
FIG. 1A is a diagram of an improved grip drum stick.

FIG. 1A is a diagram of an improved grip drum stick 10. As shown in FIG. 1A, the drum stick consists of a tip 20, shoulder 30, shaft 40, and butt 50. The present invention deals most directly with a portion of the shaft 40 of the stick 10 located towards the butt 50 called the grip area 41.

Further shown in FIG. 1A, a series of groves 100 are located along the shaft 40 of a drum stick 10 closer to the butt 50 of the stick 10 than the tip 20 end. In a preferred embodiment, the stick 10 is around 16 inches in length and around 0.6 inches in diameter. The grooves 100 are cut in a series of rows 110, with each groove 100 in each row 110 being cut at the same angle (approximately 45 degrees) relative to the lengthwise axis of the stick 10. The grooves 100 in each row 110 are spaced one inch apart and the rows 110 are offset relative to adjacent rows 110 creating two sets of rows 110 with different placements on the stick shaft 40. One set of groove rows 110 begins 0.8 inches from the butt 50 end of the stick 10 and ends 10.8 inches from the tip 20 end. The other set of groove rows 110, which are positioned radially in between the first set of rows 110 mentioned above, begin 1.3 inches from the butt 50 end of the stick 40 and end 10.3 inches from the tip 20 end.

The grooves 100 may be 0.6 inches in length, 0.1 inches at their widest, and are cut to an approximate depth of 0.1 inches at their deepest. The shape of the grooves 100 is similar to that of a prolate spheroid (e.g., the shape of a football or pistachio shell) which has been bisected along its length, with the groove's shape coming to a point at both ends. The end of each groove 100 overlaps with the offset rows 110 adjacent to it by approximately 0.13 inches. This overlap falls in the one inch spaces between the grooves 100 of each row 110.

Figure 1C:
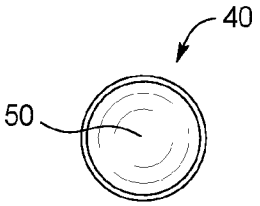
FIG. 1C is a diagram of a bottom up view of the drum stick.
Figure 1B:
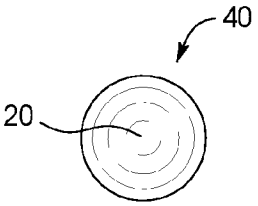
FIG. 1B is a diagram of a top down view of the drum stick

FIGS. 1B and 1C are diagrams of a top down view and bottom up view of the drum stick 10. As shown in FIG. 2B, the stick's 10 shaft 40 portion may be cylindrical in shape and taper to a tip 20. FIG. 1C further demonstrates the cylindrical shape of the shaft portion 40 as well as shows the butt 50 portion of the stick 10 does not taper like the tip portion 20 and instead is the same circumference as the shaft 40.

Figure 1D:
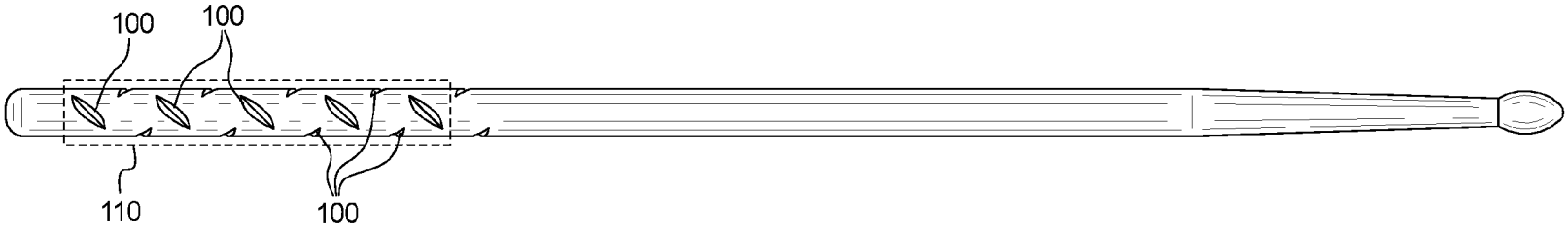
FIG. 1D is a diagram of a row of grooves on an improved grip drum stick.

FIG. 1D is a diagram of a row 110 of grooves 100 on an improved grip drum stick 10. As shown in FIG. 1D, the grooves 100 on the improved grip drum stick 10 are cut in rows 110 at regular intervals. Also shown in FIG. 1D, the grooves 100 of adjacent offset rows 110 overlap into the space between the grooves 100 of each row 110.

Figure 2A:
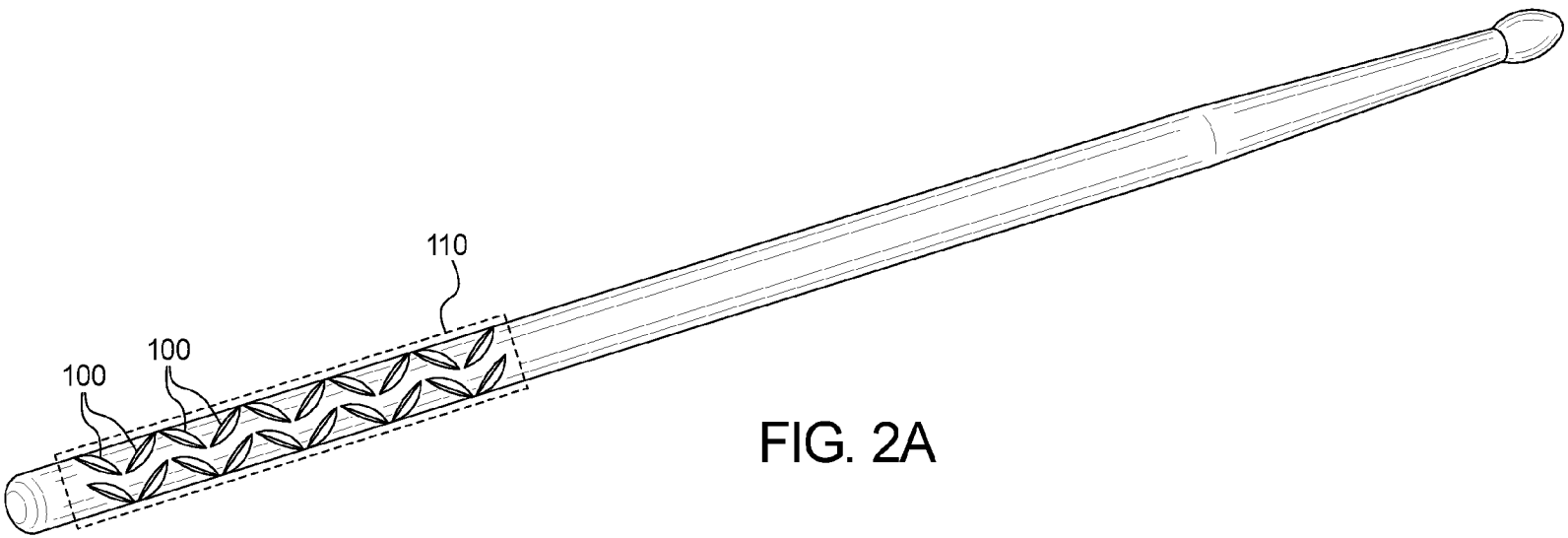
FIG. 2A is a diagram of an improved grip drum stick with an alternative groove pattern.
Figure 2B:
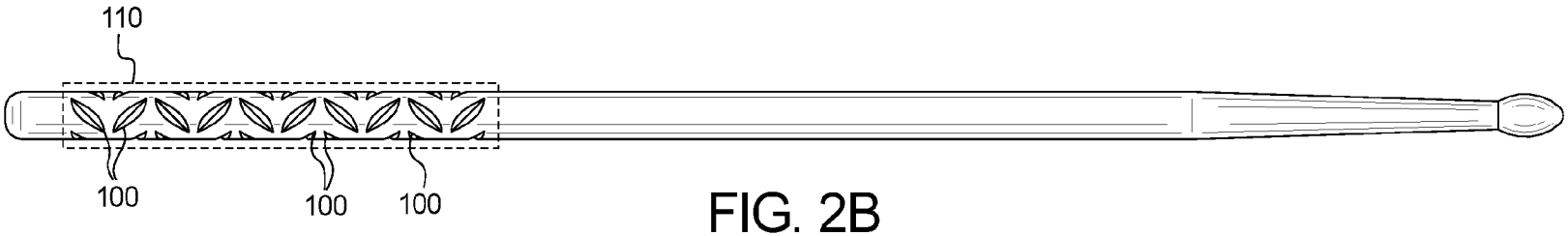
FIG. 2B is a diagram of a row of grooves with an alternative pattern on an improved grip drum stick.

FIG. 2A is a diagram of an improved grip drum stick 10 with an alternative groove 100 pattern. As shown in FIG. 2A the pattern of grooves 100 in each row 110 may be altered as needed to optimize performance. The pattern shown in FIG. 2A doubles the number of grooves 100 in each row 110 compared to the pattern described in FIGS. 1A-1D. In this example, the orientation of the grooves 100 is alternated inversely; meaning if the first groove 100 of a row 110 is cut at 45 degrees relative to the lengthwise axis of the stick 10, the next groove is cut at 135 degrees. The rows 110 are not alternatively offset like the rows of FIGS. 1A-1D, but still overlap slightly into the space between grooves 100 of adjacent rows 110.

FIG. 2B is a diagram of a row 110 of grooves 100 with an alternative pattern on an improved grip drum stick 10. As shown in FIG. 2B, the grooves 100 on the improved grip drum stick 10 are cut in rows 110 at regular intervals.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A percussion mallet comprising:

a cylindrical shaft defining a shaft axis along its length;

a tip located at a first end of the shaft;

a butt located at a second end of the shaft that is opposite the first end of the shaft; and, a plurality of grooves located along the shaft in between the butt and tip, each groove including a length, a width, and a depth, wherein the length is equal to greater than the width and the length defines a groove axis, wherein the groove axis of each of the plurality of grooves is at a skewed angle relative to the shaft axis.

2. The percussion mallet of claim 1, wherein the percussion mallet is a drum stick.

3. The percussion mallet of claim 1, wherein the plurality of grooves includes grooves arranged in two or more rows.

4. The percussion mallet of claim 1, wherein the plurality of grooves includes grooves arranged in four or more rows.

5. The percussion mallet of claim 1, wherein the plurality of grooves includes grooves arranged in two or more non-interleaving rows.

6. The percussion mallet of claim 1, wherein the plurality of grooves includes grooves arranged in two or more interleaving rows.

7. The percussion mallet of claim 1, wherein the plurality of grooves includes grooves arranged in two or more rows and each row contains at least 5 grooves.

8. The percussion mallet of claim 1, wherein the plurality of grooves includes grooves arranged in two or more rows and each row contains at least 10 grooves.

9. The percussion mallet of claim 1, wherein the groove axis of a first groove is different than a groove axis of a second groove.

10. The percussion mallet of claim 1, wherein the grooves are an prolate spheroid shape.

11. The percussion mallet of claim 1 further comprising a grip area, body, shoulder, and neck, wherein the grip area is adjacent the butt, the body is adjacent the grip area, the shoulder is adjacent the body, the neck is adjacent the shoulder, and the tip is adjacent the neck, wherein the plurality of grooves are located within the grip area.

* * * * *